United States Patent [19]

Harris

[11] 3,977,743

[45] Aug. 31, 1976

[54] COMBINATION WALL-MOUNTED TOOTHBRUSH HOLDER AND CARRYING CASE

[76] Inventor: John Madison Harris, P.O. Box 2819, West Palm Beach, Fla. 33402

[22] Filed: Sept. 29, 1975

[21] Appl. No.: 617,684

[52] U.S. Cl. ..... 312/207; 312/206; 312/245

[51] Int. Cl.[2] ..... A46B 17/00

[58] Field of Search ..... 312/206, 207, 245

[56] References Cited

UNITED STATES PATENTS

| | | | |
|---|---|---|---|
| 1,870,276 | 8/1932 | Beilock | 312/207 |
| 2,418,615 | 4/1947 | Barna | 312/207 |
| 2,422,051 | 6/1947 | Swanson | 312/207 |
| 2,592,131 | 4/1952 | Farrar | 312/207 |
| 2,655,968 | 10/1953 | Simmons | 312/206 |
| 3,138,414 | 6/1964 | Lapollo | 312/245 |

*Primary Examiner*—Robert L. Wolfe
*Assistant Examiner*—Victor N. Sakran
*Attorney, Agent, or Firm*—Jack N. McCarthy

[57] ABSTRACT

This invention relates to a combination toothbrush holder and carrying case and more particularly to one that is easily attachable and detachable to a wall type flat surface by a mounting bracket.

1 Claim, 7 Drawing Figures

COMBINATION WALL-MOUNTED TOOTHBRUSH HOLDER AND CARRYING CASE

BACKGROUND OF THE INVENTION

1. Field of the Invention

This invention relates generally to improvements in toothbrush holders, and more particularly, but not by way of limitation, to a sanitary toothbrush holder enclosure that is attachable to a vertical-type flat surface by a mounting bracket for home use and which is easily detachable from the mounted bracket for use as a carrying case when travelling.

2. Description of the Prior Art

It is well known that the use of conventional wall-mounted toothbrush holders are not suitable or practical for travel use and that the use of conventional toothbrush carrying cases are not suitable or practical for home use. It is further well known that existing combination toothbrush holders adaptable for home and travel use are impractical because of manufacturing costs, sanitary reasons, lack of durability, and inconvenience.

Various efforts have been made to improve toothbrush holders whereon cover means are provided for sanitary reasons, but to the best of my knowledge, no practical toothbrush holder with cover means such as described herein has previously been provided which is adaptable for everyday home use and can also be used as a toothbrush travel case. A prior art patent involving a combination toothbrush holder adaptable for both home and travel use is U.S. Pat. No. 3,124,399, Tooth Brush Holder, by Bruno Seta.

SUMMARY OF THE INVENTION

This invention pertains to a combination toothbrush holder and enclosure capable of being attached and detached to a vertical-type flat surface such as a wall. When detached from said vertical-type flat surface said holder enclosure can also be used as a carrying case while travelling. The device is basically comprised of an enclosure, which holds and covers the bristle portion of a toothbrush, having thereon integral attaching means for attaching to a mounted wall bracket.

It is a significant object of my invention to provide a wall-mounted toothbrush holder with cover means for keeping the toothbrush bristles clean and sanitary when the toothbrush is not in use.

Another important object of this invention is to provide a portable toothbrush holder with cover means for keeping the bristles of a toothbrush clean and sanitary when travelling.

One object of this invention is to provide a cover for a toothbrush holder which, while concealing the bristle portion of the toothbrush, will also permit free access of air for ventilation and for drying the bristles.

A further object of this invention is to provide a covered toothbrush holder that is easily detached from its permanent mounting bracket for cleaning and sterilizing if desired.

Another and final object of this invention is to provide a combination sanitary covered toothbrush holder and carrying case that will at all times be practical, effective and simple in its operation, which will also be inexpensive in construction, strong and durable.

Other objects and advantages of the invention will be evident from the following detailed description when read in conjunction with the accompanying drawings which illustrate the invention.

DESCRIPTION OF PREFERRED EMBODIMENTS

Figure 1:
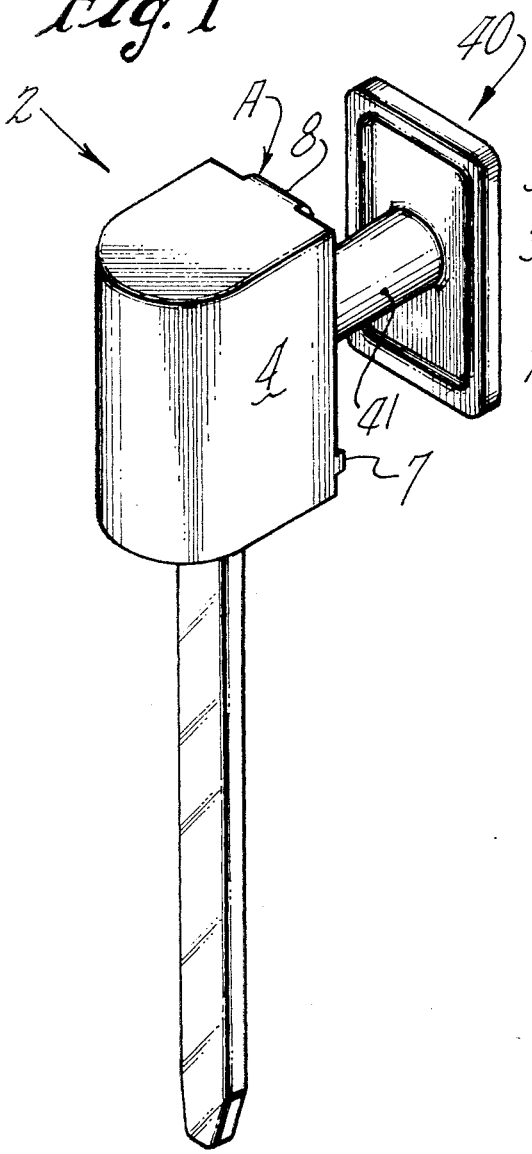
FIG. 1 is a perspective view of my invention shown mounted on the wall.

Referring to the drawings in detail, and in particularly to FIGS. 1, 2, 3, and 4, a toothbrush holder 2 is shown with an integral cover 4, holder platform 18 and fastening means 19 and with a mounting bracket 40. Toothbrush holder 2 basically comprises, in its present instance, an L-shaped holder platform 18 having an integral base section 31 at right angles to a back section 30 with reinforcement means 20, the integral base section 31 being substantially horizontal when mounted and the back section 30 substantially vertical. The end of base section 31, is semi-circular in outline and has a keyhole-type slot 23 for holding the upper portion of a toothbrush. Said slot begins at the extreme outer edge of base section 31 and ends at a point a sufficient distance past the center thereof. Back section 30 has fastening means 19 and cover 4 as integral parts. On one side of section 30 (opposite the side containing base section 31) fastening means 19 extends outwardly from a point between the top and bottom of back section 30. Cover 4 is an integral part of back section 30 connected thereto at point A with a living hinge 8. Said cover 4 is a three-sided type enclosure having the upper end closed and the side facing section 30 and its bottom side open.

Figure 2:
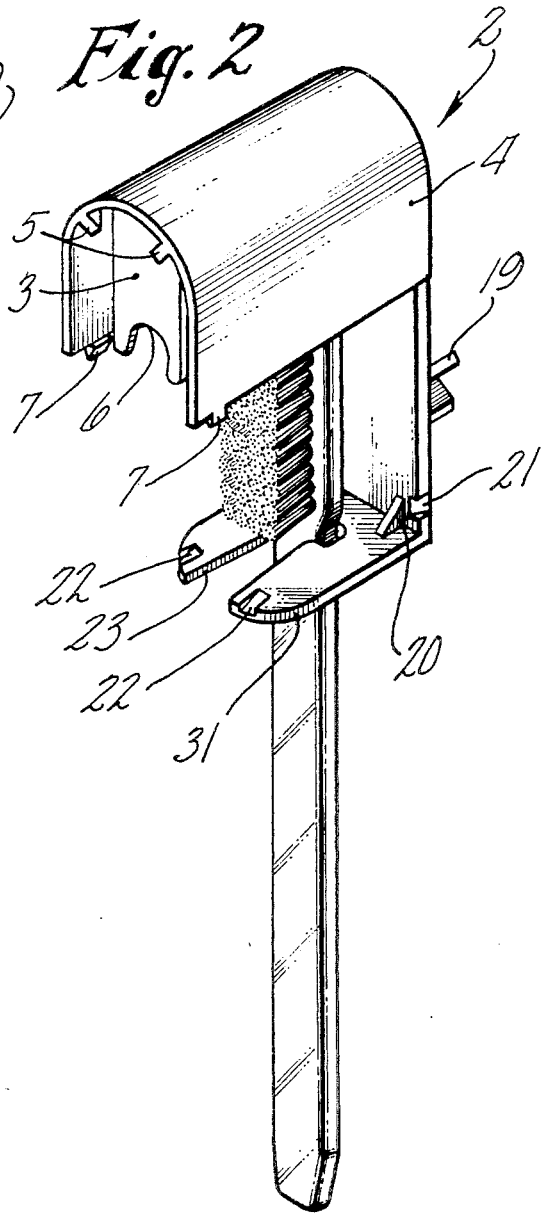
FIG. 2 is a view like FIG. 1, with the cover opened, the mounting bracket is not shown.
Figure 6:
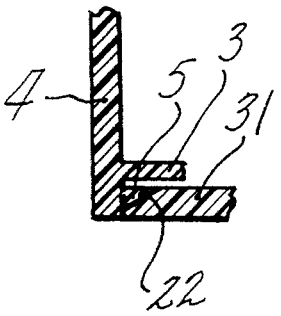
FIG. 6 is a fragmentary detail view showing one of the projections in position.
Figure 7:
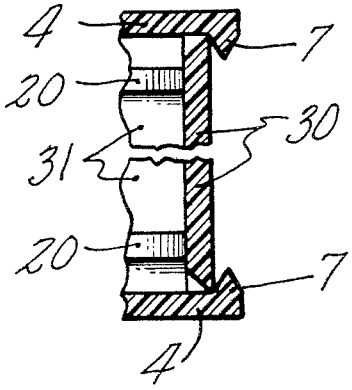
FIG. 7 is a fragmentary detail view showing the cover locking means in their locking position.
Figure 3:
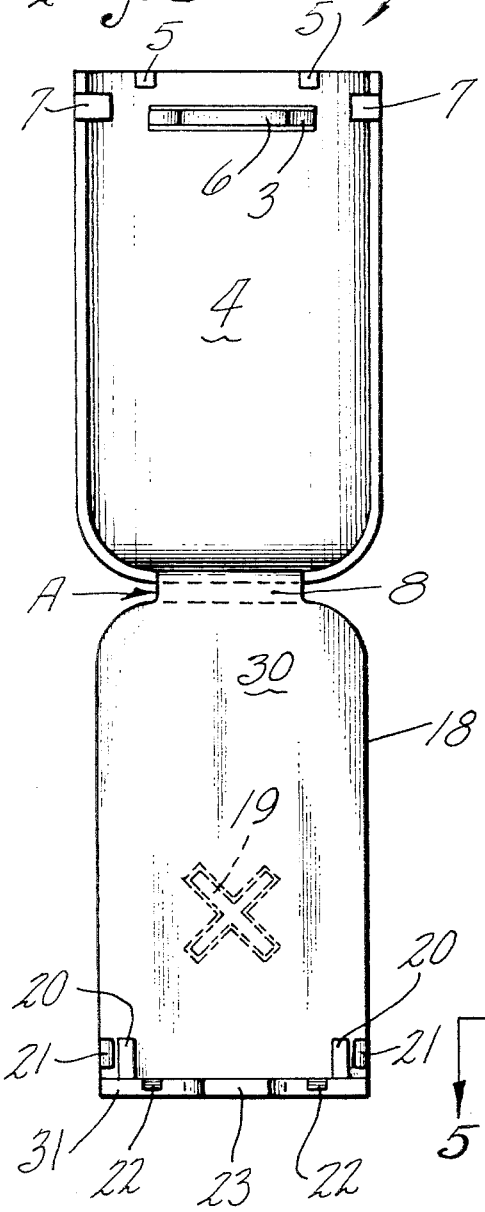
FIG. 3 is an enlarged front elevational view of my invention with the cover shown in an opened position.
Figure 4:
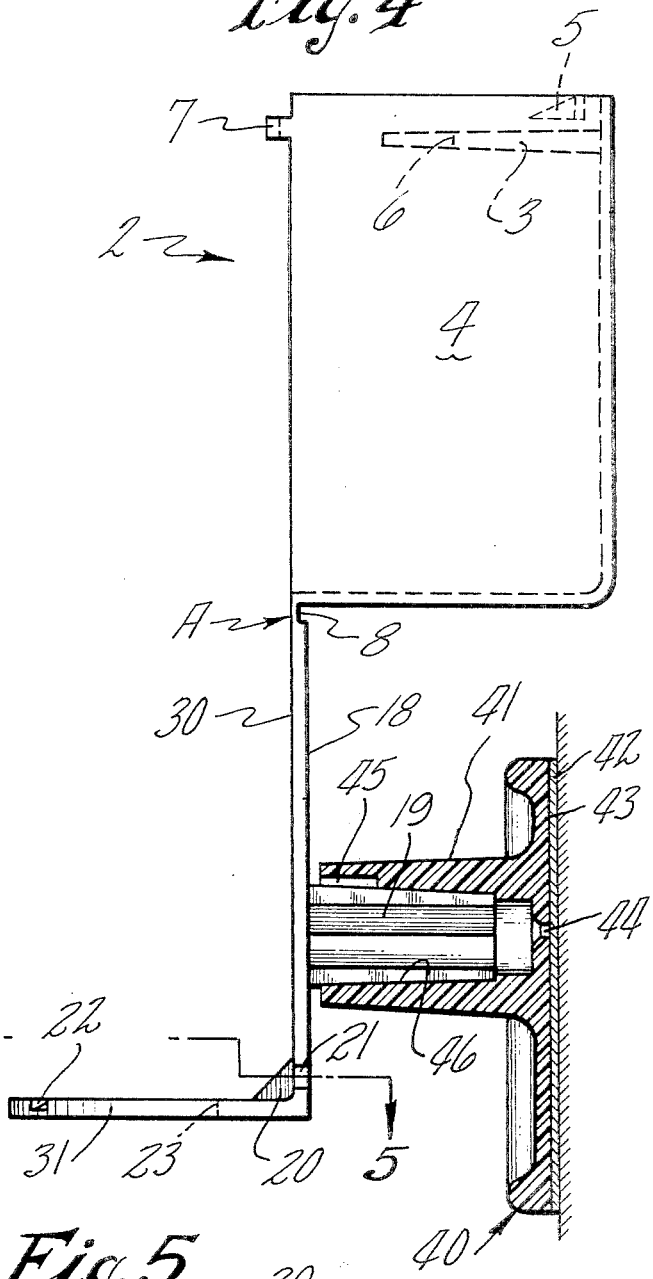
FIG. 4 is a side elevational view of FIG. 3, the mounting bracket is shown in Section to reveal certain structural details.
Figure 5:
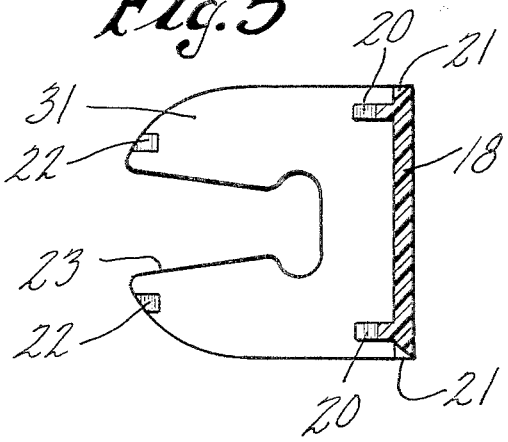
FIG. 5 is a cross-sectional view taken on line 5—5 of FIG. 4.

As shown in FIGS. 2, 3, and 4, the enclosed side of cover 4 has a flat tongue-type projection 3 with half moon slot 6 at its extremity so that when cover 4 is closed it closes off the portion of keyhole slot 23 that is not occupied by toothbrush handle which has been previously inserted therein. Said half moon slot 6 also serves as guide means for guiding the toothbrush into proper position for holding prior to locking said cover 4 to holder platform 18 by locking means comprising projections 7 and 5, and mating receiving portions 21 and 22, respectively, of the back section 30 and base section 31. As shown in FIGS. 6 and 7, projections 7 and 5 are wedge shaped as are the receiving portions 21 and 22. In a closing action, the flat sides of the wedge portions of its projections 7 and 5 which first meet the facing flat sides of the wedge portions of the receiving portions 21 and 22, cam the receiving portions outwardly, due to their resilient nature, which permits the projections 7 and 5 to move to a position behind the wedge shaped receiving portions 21 and 22 by a snap action. The opposite sides of the mating wedge portions hold or lock the cover 4 on the holder platform 18; the device opens by a reverse action.

The horizontal fastening means 19 is a cross shaped projection and is designed to mate with wall mounting bracket 40 as shown in FIG. 1. Mounting bracket 40 is a rectangular flat shaped piece of material, with beaded edges for strength, having extending outwardly therefrom a tubular boss 41 for mating with the male type fastening means 19. Said bracket 40 can be secured to a vertical-type flat surface such as a wall 37 by a pressure sensitive tape 42 which is securely adhered to the rear vertical surface 43 of mounting bracket 40. It is also possible to secure mounting bracket 40 to the wall type surface by placing a screw or nail (not shown) into such wall through the aperture 44, or other aperture, in the bracket at the base of horizontal tubular boss 41. Tubular boss 41 has a key, or flattened surface 45 running substantially parallel to its inter wall that prevents fastening means 19 from rotating relative to bracket 40 after said fastening means 19 has been press-fitted into the bore 46 of tubular boss 41.

Prior to use of the invention, as described and illustrated, it will be understood that normally fastening means 19 of toothbrush holder 2 will be press-fitted into bore 46 of tubular boss 41 of wall mounting bracket 40. To insert a toothbrush into the horizontal keyhole type slot 23, cover 4 is swung out away from vertical section 30 into the opened position as shown in FIG. 1. In this position, the brush portion of a toothbrush can be inserted into said slot 23 for holding. Cover 4 can then be swung down and locked to holder platform 18 so that the handle portion of the toothbrush is the only visible part of the toothbrush. Tongue 3 closes off the portion of keyhole slot 23 which is not filled by the toothbrush handle. The clearance between tongue 3 and horizontal base 31 and the clearance between cover 4 and vertical section 30 permit free access of air for ventilation and for drying of bristles. To remove the toothbrush from toothbrush holder 2, the user only has to grasp the handle of the toothbrush and pull outwardly, which applies pressure to unlock the cover 4 from the holder platform 18, to remove same from said cover 4 and holding platform 18. For travel use, a toothbrush is positioned in said toothbrush holder as previously described and toothbrush holder 2 is simply pulled away from mounting bracket 40.

Toothbrush holder 2 then serves as a carrying case. To reposition as a wall-mounted toothbrush holder, simply reattach to the permanent mounting bracket 40 by pressing fastening means 19 into bore 46 of tubular boss 41.

From the foregoing, it will be apparent that the present invention provides a multipurpose toothbrush holder, i.e., a covered toothbrush holder that can be left in a permanent wall-mounted position and one that can also be used as a portable covered toothbrush holder and carrying case. It will further be apparent that the present covered toothbrush holder and carrying case is practical and of economical construction.

Changes may be made in the size, for more than one toothbrush, volume, combination and arrangement of parts or elements as heretofore set forth in the specifications and shown in the drawings without departing from the spirit and scope of the invention as defined in the following claims:

I claim:

1. A toothbrush holder for keeping toothbrush bristles clean, comprising an L-shaped holder having an upstanding back portion and a bottom portion, said bottom portion being fixed to said upstanding back portion and extending therefrom to a free end, said bottom portion having a slot therein extending from its free end towards said upstanding back portion for receiving the handle of a toothbrush, said holder including a cover pivotally mounted on the top of said upstanding back portion and adapted to swing downwardly and encompass the brush portion of a toothbrush, said cover having projection means for securing said cover in a closed position on said L-shaped holder, the inside of said cover having a flat tongue-like projection that closes off the forward portion of the slot at the free end of the bottom portion of the L-shaped holder when said cover is closed, the upstanding back portion of the L-shaped having fastening means on its back located away from said bottom portion for engaging a mounting bracket for said toothbrush holder, the free end of the tongue-like projection having a slot therein for mating with the closed end of the slot in said bottom portion for confining the handle of a toothbrush.

* * * * *